US011781422B2

(12) United States Patent
Wallis et al.

(10) Patent No.: US 11,781,422 B2
(45) Date of Patent: Oct. 10, 2023

(54) HORIZONTAL DIRECTIONAL DRILLING TOOL

(71) Applicant: DV8 Technology Limited, Gloucestershire (GB)

(72) Inventors: Nicholas Peter Wallis, Worcestershire (GB); Stuart Alfred Hall, Stroud (GB)

(73) Assignee: GYROTECH LIMITED (GB)

( * ) Notice: Subject to any disclaimer, the term of this patent is extended or adjusted under 35 U.S.C. 154(b) by 0 days.

(21) Appl. No.: 17/375,496

(22) Filed: Jul. 14, 2021

(65) Prior Publication Data

US 2022/0018243 A1 Jan. 20, 2022

(30) Foreign Application Priority Data

Jul. 20, 2020 (GB) ..... 2011183

(51) Int. Cl.
*E21B 47/024* (2006.01)
*E21B 7/04* (2006.01)

(52) U.S. Cl.
CPC ..... *E21B 47/024* (2013.01); *E21B 7/046* (2013.01)

(58) Field of Classification Search
CPC ..... E21B 47/024; E21B 7/046
See application file for complete search history.

(56) References Cited

U.S. PATENT DOCUMENTS

2003/0056381 A1 3/2003 Brosnahan et al.
2010/0116550 A1* 5/2010 Hutin ..... E21B 17/003 340/853.1
2016/0281493 A1 9/2016 Kuckes
2018/0149480 A1 5/2018 Wang
2019/0169984 A1 6/2019 Smart

FOREIGN PATENT DOCUMENTS

GB 2514077 A 11/2014
WO WO-2016018273 A1 * 2/2016 ..... E21B 12/00

OTHER PUBLICATIONS

Intellectual Property Office. Combined Search and Examination Report for application GB2011183.7, dated Mar. 30, 2021. 10 pages.
European Patent Office, Communication, Application No. 21186028.3, dated Jan. 2, 2023, 7 pages.

* cited by examiner

*Primary Examiner* — Dany E Akakpo
(74) *Attorney, Agent, or Firm* — QUARLES & BRADY LLP

(57) ABSTRACT

An apparatus (100) for determining an azimuth of a drilling tool (304) during drilling of a borehole. The apparatus (100) comprises a rate sensor (102) configured to collect rate sensor data indicative of a component of a rate of rotation of the earth for determining the azimuth by gyrocompassing. The rate sensor (102) is further configured for communication with a surface unit (306). The apparatus (100) also comprises a drill pipe extension detector (104) configured to detect a process associated with extension of a drill pipe (312) connecting the drilling tool (304) to the surface unit (306). The rate sensor (102) is configured to transmit collected rate sensor data to the surface unit (306) based on the detected process associated with extension of the drill pipe (312).

18 Claims, 5 Drawing Sheets

HORIZONTAL DIRECTIONAL DRILLING TOOL

CROSS REFERENCE TO RELATED APPLICATIONS

This application claims benefit of United Kingdom application 2011183.7 filed Jul. 20, 2020. The contents of this application is hereby incorporated by reference as set forth in its entirety herein.

TECHNICAL FIELD

The invention relates to methods and apparatus for determining an azimuth of a drilling tool. In particular, the invention may relate to methods and apparatus for determining an azimuth of a drilling tool in horizontal directional drilling applications.

BACKGROUND

Horizontal directional drilling is typically used to install telecommunications, power cable conduits, water lines, sewer lines, gas lines and other utilities under roadways/water ways, or in environmentally sensitive/congested areas. In typical horizontal direction drilling operations, a drilling rig located on surface is used to apply force to a drilling tool to create a borehole based on a proposed path. The borehole extends between a surface entry point and a surface exit point.

It is important that the borehole is drilled according to the proposed path not only so that the utility is installed correctly, but because deviation from the proposed path may result in the drilling tool impacting and damaging adjacent pipelines or conduits. While drilling, the operator/driller may rely on guidance systems to track the location of the drilling tool between the entry and exit points. This allows the operator/driller to take corrective action if the drilling tool, and therefore the borehole that is being created, deviates from the proposed path.

For short and shallow borehole paths, the location of the drilling tool may be tracked during the drilling operation using "walkover" methods. For example, the drilling tool may comprise an RF beacon. The location of the drilling tool may be determined by measuring the signal strength of the RF beacon as an operator "walks over" the surface above the proposed path of the borehole.

For longer and deeper boreholes, magnetic guidance systems may be used. In such systems magnetometers and accelerometers may be coupled to the drilling tool to provide the driller with information relating to the borehole, such as the angle from vertical (or inclination) and the direction relative to magnetic north. In clean magnetic environments (i.e. environments free from magnetic interference), relatively accurate position information can be obtained using magnetometers. However, often these measurements are subject to magnetic interference effects caused by adjacent pipelines, obstructions and drill pipes. Therefore, it is often necessary to use additional reference guidance techniques on surface. For example, these additional reference guidance systems may comprise grids of cable at the planned entry and exit points of the borehole, with known reference locations. By passing current through the grids of cable in a positive and negative direction, the interference effects of other magnetic sources can be eliminated from the magnetometer measurements and the position of the magnetometers in the borehole can be established relative to the surface grid.

A disadvantage associated with magnetic guidance systems and walkover methods is that it is not always possible to use the surface over the entire proposed path of the borehole. For example, portions of the proposed borehole path may pass under bodies of water and it is therefore not possible to erect grids of cable over these portions or walk over them As such, there may be extended periods of "blind" drilling, where the operator/driller is reliant on looking at trends in the data from the magnetometers and accelerometers on the drilling tool without the use of the surface reference guidance system, such as the grid of cable, to eliminate interference effects. In these situations, the driller is reliant on the "next" grid of cable that the drilling tool passes beneath, which may be the grid of cable at the exit point, to allow correction of any deviation from the proposed borehole path that occurred in the blind section. While this may ensure that the drilling tool exits at the correct point, there is no guarantee that the path followed by the drilling tool before the exit matches the proposed path.

The inventors have recognised the need to provide an accurate method of tracking the location of a drilling tool that overcomes the disadvantages associated with known guidance systems.

SUMMARY

According to the invention in a first aspect, there is provided an apparatus for determining an azimuth of a drilling tool during drilling of a borehole, and comprising: a rate sensor configured to collect rate sensor data indicative of a component of a rate of rotation of the earth for determining the azimuth by gyrocompassing, and further configured for communication with a surface unit; and a drill pipe extension detector configured to detect a process associated with extension of a drill pipe connecting the drilling tool to the surface unit, wherein the rate sensor is configured to transmit collected rate sensor data to the surface unit based on the detected process associated with extension of the drill pipe.

Optionally, the drill pipe extension detector is configured to detect completion of the process associated with extension of the drill pipe and control the rate sensor to terminate collection of the rate sensor data and transmit previously collected rate sensor data to the surface unit. Optionally, the rate sensor may continuously collect rate sensor data until the drill pipe extension detector detects completion of the process associated with extension of the drill pipe.

Optionally, the drill pipe extension detector is configured to detect initiation of the process associated with extension of the drill pipe and control the rate sensor to commence collection of the rate sensor data. Optionally, the drill pipe extension detector is configured to control the rate sensor to transmit the collected rate sensor data on detection of completion of the process associated with extension of the drill pipe.

Optionally, the drill pipe extension detector is configured to determine that the apparatus is stationary during the process associated with the extension of the drill pipe.

Optionally, the process associated with extension of the drill pipe comprises one or more of: a loss of communication between the rate sensor and the surface unit; a sequence of movements of the drill pipe; a change in detected pressure in the borehole; a detected shock experienced by the apparatus; and a change in detected vibration and/or acceleration of the apparatus.

Optionally, the process associated with extension of the drill pipe comprises a loss of communication between the rate sensor and the surface unit. Optionally, the rate sensor is configured to collect rate sensor data when loss of communication is detected. Optionally, the rate sensor is configured to continuously collect rate sensor data and the drill pipe extension detector is configured to control the rate sensor to terminate collection of the rate sensor data and transmit previously collected rate sensor data to the surface unit on reestablishment of communication between the rate sensor and the surface unit.

Optionally, the communication between the rate sensor and the surface unit is electrical power communication and/or data communication.

Optionally, the drill pipe extension detector comprises a connection detector and the communication is electrical power communication, and the surface unit comprises an external power source in electrical power communication with the rate sensor such that the rate sensor receives electrical power from the external power source, and the apparatus further comprises a local power source configured to provide electrical power to the rate sensor when the connection detector detects loss of electrical power communication between the rate sensor and the external power source.

Optionally, the rate sensor and/or the local power source is located on the drilling tool.

Optionally, the external power source is located at surface.

Optioanlly, the local power source is configured not to provide electrical power to the rate sensor when electrical power is received from the external power source.

Optionally, the rate sensor is configured to receive electrical power from the external power source along the drill pipe connecting the drilling tool to the surface unit.

Optioanlly, electrical power is not received from the external power source during the process associated with extension of the drill pipe.

Optionally, the apparatus further comprises the external power source and/or the drill pipe.

Optionally, the rate sensor is configured to collect the data indicative of a rate of rotation of the earth until the rate sensor is again in communication with the surface unit.

Optionally, the rate sensor is configured to collect the data indicative of the rate of rotation of the earth by taking measurements at a plurality of angular orientations.

Optionally, the apparatus further comprises a transmitter configured to transmit the data indicative of a rate of rotation of the earth.

Optionally, the transmitter is configured to transmit the data indicative of a rate of rotation of the earth on completion of the process associated with extension of the drill pipe. Optionally, completion of the process associated with extension of the drill pipe may comprise one or more of: detection of reestablishment of communication between the rate sensor and the surface unit; detection of a resumption of drilling by the drilling tool; detection of a sequence of movements of the drill pipe; detection of a change in pressure in the borehole; detection of a threshold shock experienced by the apparatus; and detection of a change in vibration and/or acceleration of the apparatus.

Optionally, the local power source comprises a rechargeable battery.

Optionally, the rechargeable battery is configured to recharge using electrical power received from the external power source.

Optionally, the rechargeable battery is configured to enter a sleep mode if electrical power is not received from the external power source for a threshold period of time.

Optionally, the apparatus further comprises a battery charge indicator configured to determine a power level of the rechargeable battery and control the transmitter to transmit battery status information when electrical power is received from the external power source.

Optionally, the rate sensor comprises a MEMs gyro sensor.

According to the invention in a further aspect, there is provided horizontal directional drilling tool for creating a borehole and comprising the apparatus of any of claims 1 to 22.

According to the invention in a further aspect, there is provided a method for determining an azimuth of a drilling tool, the method comprising: communicating, by a rate sensor, with a surface unit; detecting, by a drill pipe extension detector, a process associated with extension of a drill pipe connecting the drilling tool to the surface unit; and transmitting, by the rate sensor, collected rate sensor data indicative of a component of a rate of rotation of the earth, for determining the azimuth by gyrocompassing, to the surface unit, based on the detected process associated with extension of the drill pipe.

Optionally, the method comprises detecting, by the drill pipe extension detector, completion of the process associated with extension of the drill pipe. Optionally, the method further comprises controlling, by the drill pipe extension detector, the rate sensor to terminate collection of the rate sensor data and transmit previously collected rate sensor data to the surface unit on detection of completion of the process associated with extension of the drill pipe.

Optionally, the method comprises detecting, by the drill pipe extension detection, initiation of the process associated with extension of the drill pipe. Optionally, the method further comprises controlling, by the drill pipe extension detector, the rate sensor to commence collection of the rate sensor data. Optionally, the method further comprises controlling, by the drill pipe extension detector, the rate sensor to transmit the collected rate sensor data on detection of completion of the process associated with extension of the drill pipe.

Optionally, detecting the process associated with extension of the drill pipe comprises detecting one or more of: a loss of communication between the rate sensor and the surface unit; a sequence of movements of the drill pipe; a change in pressure in the borehole; a detected shock experienced by the apparatus; and a change in vibration and/or acceleration of the apparatus.

Optionally, the drill pipe extension detector comprises a connection detector and the process associated with extension of the drill pipe comprises a loss of communication between the rate sensor and the surface unit. Optionally, the communication between the rate sensor and the surface unit is electrical power communication and/or data communication. Optionally, the surface unit comprises an external power source in electrical power communication with the rate sensor such that the rate sensor receives electrical power from the external power source, and the method further comprises providing, by a local power source, electrical power to the rate sensor when the connection detector detects loss of electrical power communication between the rate sensor and the external power source.

Optionally, the method further comprises receiving, by the rate sensor and from the external power source, electrical power along the drill pipe connecting the drilling tool to the surface unit.

Optionally, collecting, by the rate sensor, the rate sensor data by taking measurements at a plurality of angular orientations.

Optionally the local power source comprises a rechargeable battery and the method further comprises recharging the rechargeable battery using electrical power received from the external power source.

According to the invention in a further aspect, there is provided a computer program comprising instructions which, when executed on at least one processor, cause the at least one processor to control an apparatus to carry out a method according to claim 24.

DETAILED DESCRIPTION

Figure 1:
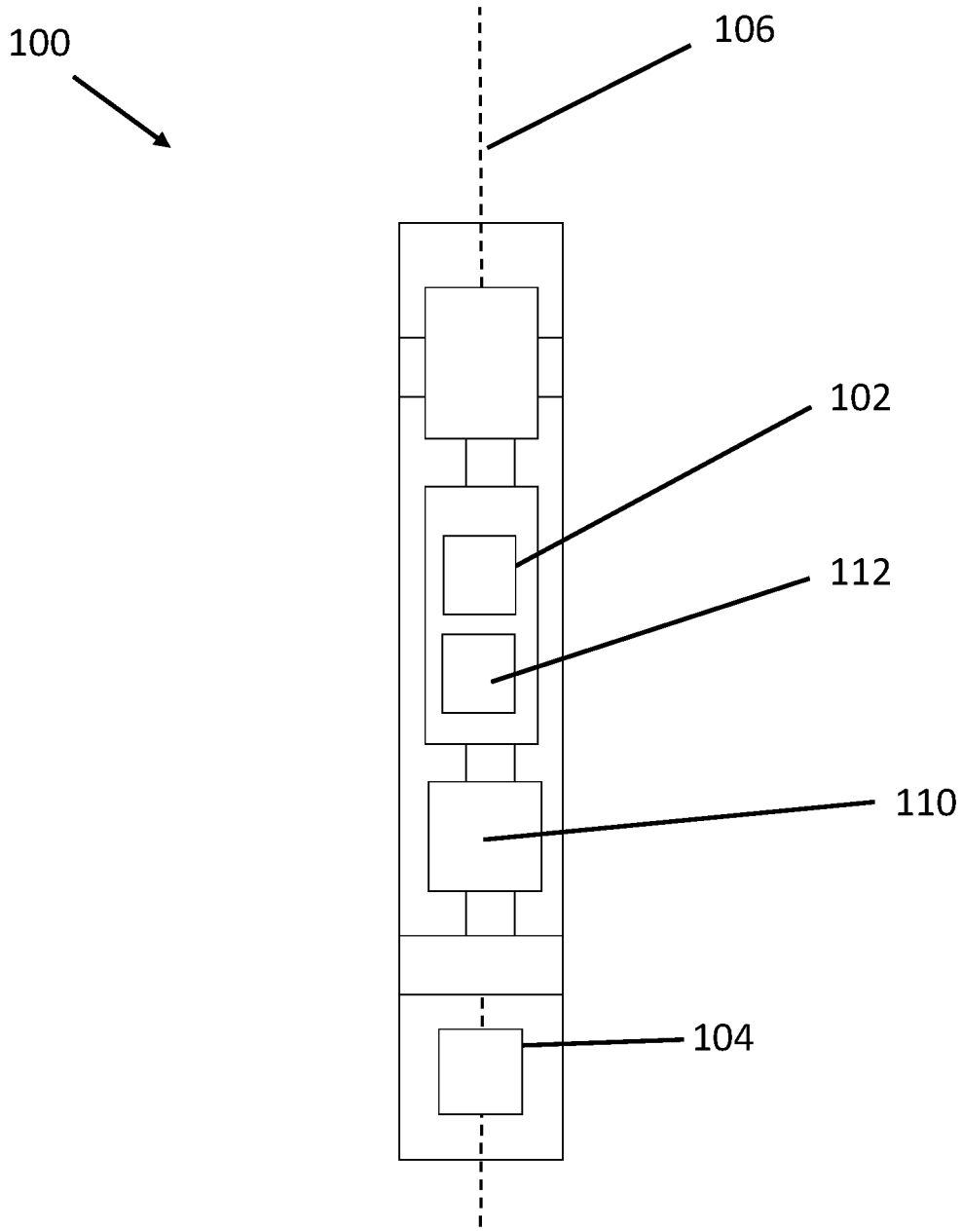
FIG. 1 is a schematic view of an exemplary apparatus.

Generally disclosed herein are methods and apparatus for determining an azimuth of a drilling tool. The apparatus may be configured for coupling to the drilling tool. Exemplary apparatus may comprise a rate sensor configured to collect data indicative of its direction with respect to the earth's axis of rotation, for determining the azimuth by gyrocompassing. In other words, the rate sensor may collect data along a sensing axis indicative of a component of the earth's rate of rotation along the sensing axis. The components of the earth's rate of rotation may be then be resolved to determine the azimuth.

To allow accurate determination of the azimuth by gyrocompassing, it is preferable for the data to be collected by the rate sensor when the rate sensor is stationary. During borehole drilling operations, the drilling tool is typically stationary during a process associated with extension of a drill pipe, the drill pipe connecting the drilling tool to a surface unit located on surface. Extension of the drill pipe may comprise new sections of drill pipe being connected to one or more sections of drill pipe at surface as the borehole advances. The inventors have realised that the apparatus, and therefore the rate sensor, will also be stationary when during processes associated with extension of the drill pipe, such as when a new section of drill pipe is connected at surface. Since connection of a new section of drill pipe may take up to several minutes, and collection of data for determination of the azimuth by gyrocompassing may take approximately 60 to 90 seconds, the process of extending the drill pipe provides sufficient time for the rate sensor to collect the data needed. Advantageously, the data necessary to enable determination of the azimuth may therefore be collected without interruption of the drilling process. As such, operation efficiency of the drilling process is not impacted and accurate and independent estimations of the borehole path are established at each drill pipe connection point.

The inventors have also realised that processes associated with extension of the drill pipe may be detected and used as a proxy for confirmation that the apparatus is stationary, and that therefore data collected by the rate sensor during extension of the drill pipe may be used to determine azimuth by gyrocompassing. For example, one process associated with extension of the drill pipe may comprise loss of power and/or communication between the rate sensor and the surface unit. In such arrangements, power may be supplied to the drilling tool and/or apparatus along the drill pipe. The power may be supplied to the rate sensor by an external power source, located for example at surface. The external power source may be disconnected from the apparatus, and specifically the rate sensor, while new sections of drill pipe are being source connected at surface. Exemplary apparatus may therefore comprise a local power source, which may be located on the apparatus or on the drilling tool. The local power source may be configured to provide electrical power to the rate sensor when electrical power is not received from the external power source, for example, when a section of drill pipe is being connected. The rate sensor may be configured to collect the data indicative of the earth's rate of rotation when the electrical power is received by the rate sensor from the local power source and not the external power source. In this way, power may be supplied to the rate sensor to enable collection of data by the rate sensor while the apparatus is stationary.

In alternative arrangements, the process associated with extension of the drill pipe may comprise loss of data communication between the rate sensor (or drilling tool) and the surface unit. In further arrangements, the process associated with extension of the drill pipe may comprise one or more of: a detected sequence of movements of the drill pipe itself, a change in detected pressure in the borehole (for example, a change of pressure in drilling fluid located in the borehole), a detected shock experienced by the apparatus (or drilling tool), or a change in vibration and/or acceleration of the apparatus (or drilling tool).

Detection of any of the above-mentioned events or states may be used as a proxy for confirmation that the apparatus is, or has been stationary, and that therefore data collected by the rate sensor during the stationary period may be used to determine azimuth by gyrocompassing.

FIG. 1 shows a schematic view of an exemplary apparatus 100 for determining an azimuth of a drilling tool.

The apparatus 100 may comprise a rate sensor 102 and a drill pipe extension detector 104.

The rate sensor 102 may be configured to collect data indicative of its direction with respect to the earth's rotation axis. In exemplary arrangements, the rate sensor 102 may comprise a gyro sensor, which may be a MEMs gyro sensor. The MEMs gyro sensor may comprise a single axis gyro sensor. In the exemplary arrangement shown in FIG. 1, the apparatus 100 comprises a single rate sensor 102. The skilled person will appreciate that in alternative arrangements, the apparatus 102 may comprise two or more rate sensors.

The rate sensor 102 may comprise a sensing axis. The rate sensor 102 may be configured to collect data along the sensing axis. As such, data indicative of a component of the earth's rate of rotation along the sensing axis may be collected by the rate sensor. In exemplary arrangements, the rate sensor 102 comprises a single sensing axis. The skilled person will appreciate that in alternative arrangements, the rate sensor 102 may comprise multiple sensing axes, for example, two or three sensing axes perpendicular to one another.

The rate sensor 102 may be rotatable about an axis of the apparatus 100. In exemplary arrangements, the rate sensor 102 may be rotatable about more than one axis of the apparatus 100. For example, the rate sensor 102 may be rotatable about a longitudinal axis 106 of the apparatus 100 and/or a second axis different to the longitudinal axis. The second axis may be an axis perpendicular to the longitudinal axis 106 of the apparatus 100. Rotation of the rate sensor 102 about an axis may allow data to be collected along the sensing axis at multiple orientations. Rotation of the rate sensor 102 about different axes of the apparatus 100 may allow data to be collected by the rate sensor 102 in different planes.

Exemplary apparatus 100 comprise a drive assembly 110 configured on actuation thereof to rotate the rate sensor 102 about at least one of the longitudinal axis 106 and the perpendicular axis. The skilled person will be able to envisage many arrangements that would allow rotation of the rate sensor 102 about an axis of the apparatus. For example, exemplary drive assemblies 110 may comprise a motor and a lead screw or gear arrangement.

In exemplary arrangements, the rate sensor 102 may be rotatable about the longitudinal axis 106 and the perpendicular axis through 360 degrees. In further exemplary arrangements, the rate sensor 102 may be rotatable about the longitudinal axis 106 by 360 degrees and the perpendicular axis by less than 180 degrees.

The exemplary apparatus 100 may further comprise an accelerometer 112 to measure the angle of the apparatus 100 relative to vertical. The accelerometer 112 may be configured to collect data indicative of inclination. The accelerometer 112 may be rotatable about one or more axes of the apparatus 100. For example, the accelerometer 112 may be rotatable about at least one of the longitudinal axis 106 and an axis perpendicular to the longitudinal axis 106. The accelerometer may comprise a three-axis accelerometer configured to collect data along three perpendicular axes.

The rate sensor 102 and the accelerometer 112 may be rotatable about the axes of the apparatus independently of each other. In exemplary arrangements, a drive assembly 110 may be configured to rotate the rate sensor 102 on actuation thereof, and a further drive assembly may be configured to rotate the accelerometer 112 on actuation thereof.

In the arrangement of FIG. 1, the apparatus 100 comprises the drill pipe extension detector 104. In alternative arrangements, the drill pipe extension detector 104 may be located on a drilling tool to which the apparatus 100 is to be coupled. The drill pipe extension detector 104 may be configured to detect a process associated with extension of a drill pipe, as will be explained in more detail below.

In exemplary arrangements, the drill pipe extension detector 104 may comprise one or more of: a connection detector, which may comprise a power source monitor and/or a data communications detector; a pressure sensor; an accelerometer; and/or a vibration sensor.

Figure 2:
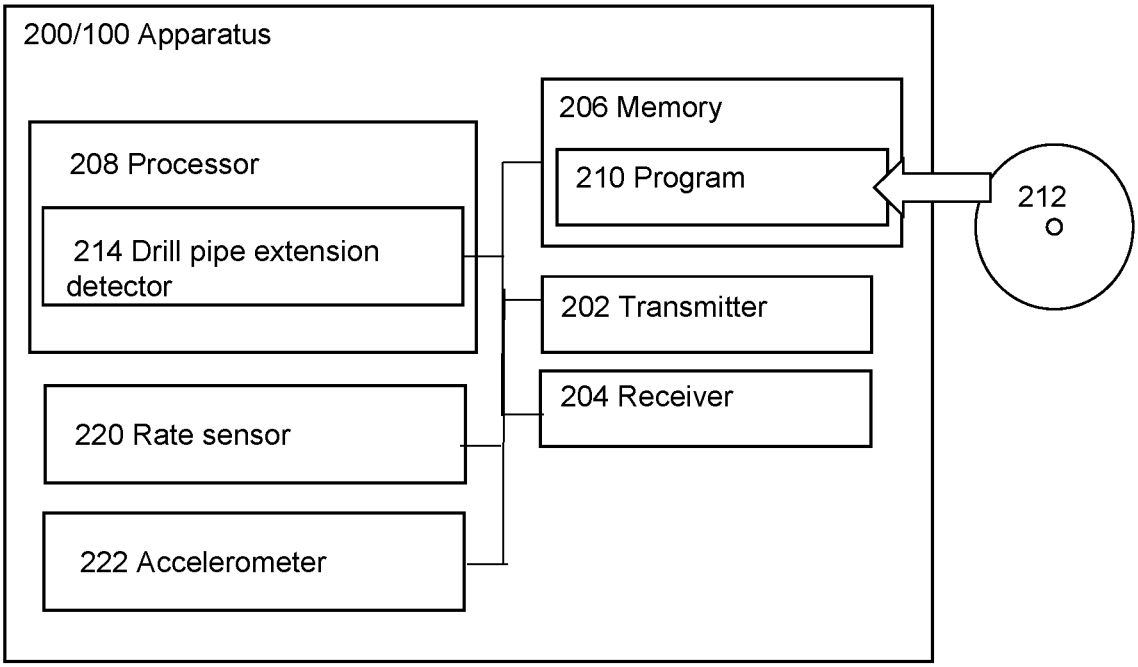
FIG. 2 is a schematic view of an exemplary apparatus.

FIG. 2 shows a schematic representation of an apparatus 200, which may be the apparatus 100 shown in FIG. 1. The apparatus 200 comprises a transmitter 202 and may optionally comprise a receiver 204. The transmitter 202 and/or receiver 204 may be in data communication with other entities, such as further apparatus, user equipment, servers and/or functions in a telecommunications network and are configured to transmit and receive data accordingly.

The apparatus 200 may further comprise a memory 206 and a processor 208. The memory 206 may comprise a non-volatile memory and/or a volatile memory. The memory 206 may have a computer program 210 stored therein. The computer program 210 may be configured to undertake the methods disclosed herein. The computer program 210 may be loaded in the memory 206 from a non-transitory computer readable medium 212, on which the computer program is stored. The processor 208 may be configured to undertake the functions of a drill pipe extension detector 214 (which may be the drill pipe extension detector 104), as set out below. The apparatus 200 may also comprise one or more of: a rate sensor 220 (which may be the rate sensor 102) and an accelerometer 222 (which may be the accelerometer 112), and the processor 208 may be configured to control these features.

Each of the transmitter 202, receiver 204, memory 206, processor 208, drill pipe extension detector 214, rate sensor 220 and accelerometer 222 may be in data communication with the other features 202, 204 206, 208, 214, 220, 222 of the apparatus 200. The apparatus 200 may be implemented as a combination of computer hardware and software. In particular, the drill pipe extension detector 214 may be at least partially implemented as software configured to run on the processor 208. The memory 206 may store the various programs/executable files that are implemented by a processor 208, and also provides a storage unit for any required data. The programs/executable files stored in the memory 206, and implemented by the processor 208, can include the drill pipe extension detector 214, but is not limited to such.

Figure 3:
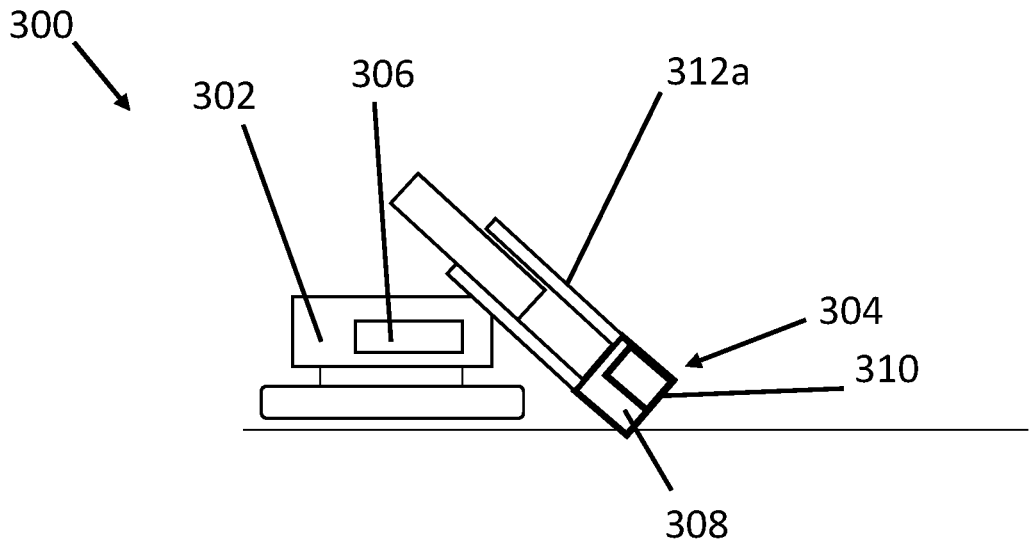
FIG. 3 is a schematic view of an exemplary drilling rig assembly.

FIG. 3 shows an exemplary drilling rig assembly 300.

The drilling rig assembly 300 may comprise a drill rig 302 and a drilling tool 304.

The drill rig 302 may comprise a surface unit 306. In the exemplary arrangement of FIG. 3, the surface unit 306 is located on the drill rig 302, however the skilled person will appreciate that the surface unit 306 may be separate to the drill rig 302 in alternative arrangements.

The drilling tool 304 may comprise a drill bit 308 and may further comprise a motor 310 configured to rotate the drill bit 308 on actuation thereof.

Exemplary drilling rig assemblies 300 may receive at least one section of drill pipe 312*a*. The drilling tool 304 may be connected to the surface unit 306 via the drill pipe 312*a*. In exemplary arrangements, the drilling tool 304 is coupled to the drill rig 302 via the section of drill pipe 312*a*.

The section of drill pipe 312*a* may be extendible. For example, the at least one section of drill pipe 312*a* may be connectable to further sections of drill pipe such that the overall length of the drill pipe is increased. In exemplary arrangements, the at least one section of drill pipe 312*a* may be mechanically and electrically connected to further sections of drill pipe.

The section of drill pipe 312*a* may comprise a conductor cable. The drilling tool 304 may be electrically coupled to the surface unit 306 via the conductor cable. As such, electrical power can be provided to the drilling tool 304 by along the drill pipe 312*a*. As further sections of drill pipe are connected to the at least one section of drill pipe 312*a*, the drilling tool 304 may receive electrical power along the section of drill pipe 312*a* and the further sections of drill pipe. Data communication may also occur between the drilling tool 304 and the surface unit 306 along the sections of drill pipe. That is, the apparatus 100 and/or the drilling tool 304 may receive data signals along the sections of drill pipe.

An exemplary method for determining the azimuth of a drilling tool during a drilling operation and using the apparatus 100 is described below with reference to FIGS. 4*a*-4*d*.

The skilled person will appreciate that the azimuth angle is the angle formed in the horizontal plane with respect to true north. By determining the azimuth of the apparatus and/or drilling tool, the direction of the corresponding portion of the borehole with respect to true north may be determined. The inclination may be defined as the angle from the vertical. As such, by determining the inclination of the apparatus 100 and/or the drilling tool 304, the inclination of the corresponding portion of the borehole may be determined. A "survey" of the borehole may be taken by determining one or more of azimuth, inclination and depth of the borehole at a plurality of points along the borehole.

Figure 4A:
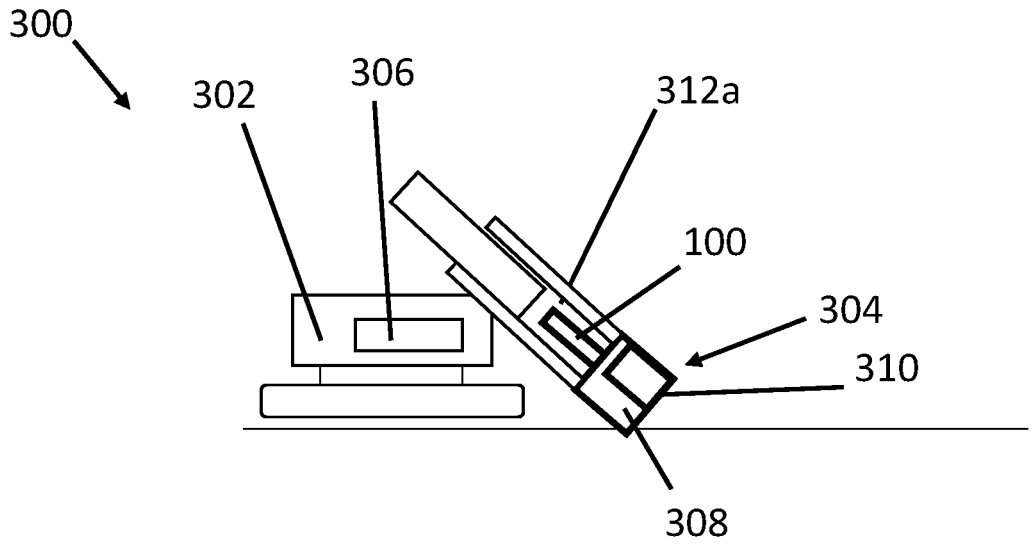
FIG. 4*a* is a schematic view of an exemplary drilling rig assembly at a first stage of operation.

FIG. 4*a* shows a drilling rig assembly 300 before commencement of a drilling operation.

The apparatus 100 may be mounted to the drilling tool 304. In exemplary arrangements, the apparatus 100 may be removeably mounted to the drilling tool 306. In the arrangement shown in FIG. 4*a*, the apparatus 100 is mounted behind the drilling tool 304. That is, the apparatus 100 may mounted to the drilling tool 304 rearwards of the drill bit 308. Mounting the apparatus 100 to the drilling tool 304 may comprise mechanically fixing the apparatus 100 to the drilling tool 304.

As described above, the drilling tool 304 may be coupled to a first end of a first section of drill pipe 312*a*. An opposed end of the first section of drill pipe 312*a* may be coupled to the drill rig 302 such that the drill rig 302 may apply a force to the drilling tool 304 via the first section of drill pipe 312*a*. The drilling tool 304 may receive power and/or data communications along the drill pipe 312*a*.

The drilling tool 304 may be actuated. In the exemplary drilling rig assembly 300, actuating the drilling tool 304 comprises actuating the motor 310 to rotate the drill bit 308. In exemplary arrangements, the motor 310 may be actuated using electrical power supplied along the first section of drill pipe 312*a*. The drill rig 302 may apply a force to the drilling tool 304 via the first section of drill pipe 312*a*. This causes the drill bit 308 to begin drilling through the ground and creation of the borehole begins. The skilled person will appreciate that this is an exemplary method of drilling a borehole and that alternative methods may be used in combination with the apparatus 100. For example, in alternative methods, the drilling rig assembly 300 may comprise a jetting assembly. In such arrangements, actuating the drilling tool may comprise actuating the jetting assembly to divert a jet of water out of the drill bit 308 to create the borehole.

Figure 4B:
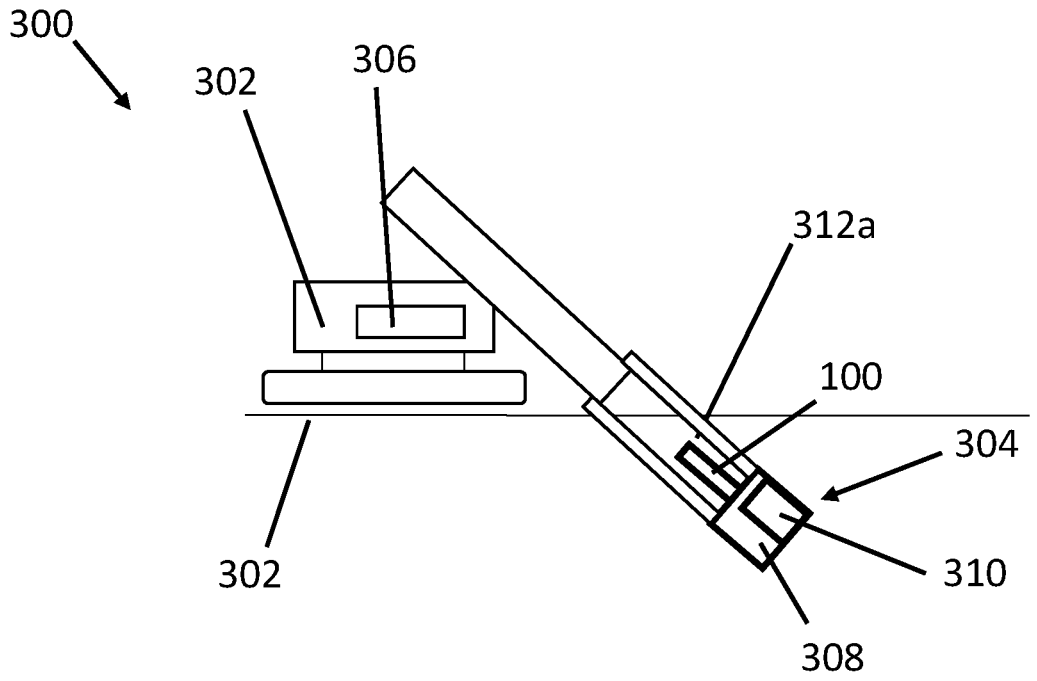
FIG. 4*b* is a schematic view of an exemplary drilling rig assembly at a second stage of operation.

The drill rig 302 may continue to apply the force to the drilling tool 304 until a required depth is reached, see for example, FIG. 4*b*. This may be a required depth of the drilling tool 304 and/or the first section of drill pipe 312*a*.

Figure 4C:
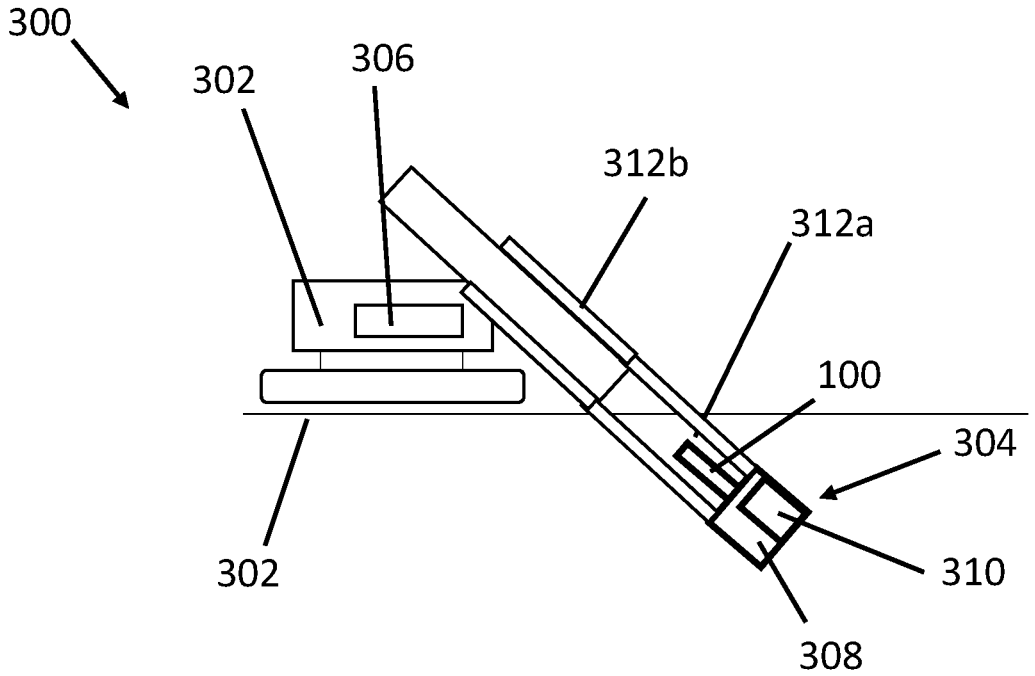
FIG. 4*c* is a schematic view of an exemplary drilling rig assembly at a third stage of operation.
Figure 4D:
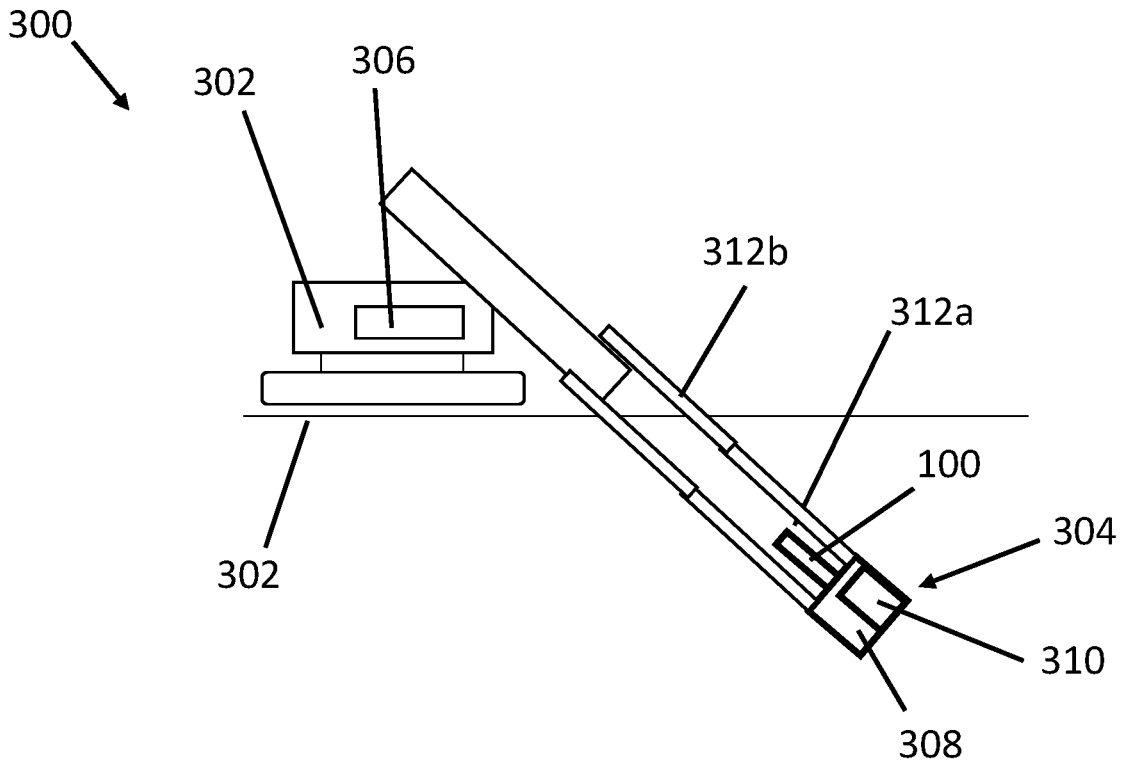
FIG. 4*d* is a schematic view of an exemplary drilling rig assembly at a fourth stage of operation.

Once the required depth is reached extension of the drill pipe 312*a* may be undertaken. In exemplary arrangements, extension of the drill pipe 312*a* comprises a further section of drill pipe 312*b* being connected to the first section of drill pipe 312*a* at surface, as shown in FIG. 4*c*. During connection of the further section of drill pipe 312*b* to the first section of drill pipe 312*a*, the drilling tool 304 is stationary, and therefore so is the apparatus 100.

The drill pipe extension detector 104 detects a process associated with extension of the drill pipe. For example, in exemplary arrangements, connecting the further section of drill pipe 312*b* to the first section of drill pipe 312*a* may result in a loss of power and/or data communication between the rate sensor 102 and the surface unit 306. In such arrangements, the drill pipe extension detector 104 may comprise a connection detector configured to detect the loss of power and/or data communication between the rate sensor 102 and the surface unit 306. In alternative arrangements, the process associated with extension of the drill pipe may be detection of a threshold vibration, or a threshold change in vibration, or the apparatus 100. In such arrangements, the drill pipe extension detector 104 may comprise a vibration sensor configured to detect vibration associated with the apparatus 100, and a threshold vibration associated with extension of the drill pipe.

In exemplary arrangements, detection of the process associated with the extension of the drill pipe may cause initiation of collection of data by the rate sensor 102. Initiating collection of data by the rate sensor may comprise commencing measurement by the rate sensor, e.g. switching the rate sensor on, or alternatively in arrangements in which the rate sensor is continuously on, storing any data collected by the rate sensor 102 after initiation. In alternative arrangements, initiating the collection of data by the rate sensor 102 may comprise switching a measurement mode of the rate sensor, for example, switching the rate sensor from a continuous measurement mode to a gyrocompass measurement mode.

The data collected by the rate sensor 102 based on the detected process associated with the extension of the drill pipe may then be transmitted to the surface unit 306.

In further arrangements, detection of the process associated with the extension of the drill pipe may cause the rate sensor 102 to terminate collecting data and transmit previously collected data to surface. For example, the drill pipe extension detector 104 may be configured to detect substantially the end of a process associated with extension of the drill pipe, and therefore the end of a stationary period. In alternative arrangements, the drill pipe extension detector 104 may be configured to detect that drilling has resumed. Resumption of drilling may be indicative that extension of the drill pipe has been completed. Detection of resumption of the drilling may cause the rate sensor to terminate collection of data and transmit previously collected data to the surface.

In such arrangements, the rate sensor 102 may be continuously collecting and storing data during the drilling operation. On detection of the process associated with extension of the drill pipe, the rate sensor 102 may be commanded to terminate collecting data and transmit the data collected and stored during a time period prior to termination to the surface unit 306. The time period may be a time period during which the apparatus 100 is determined to be stationary. The time period may be fixed. In further alternative arrangements, a fixed number of data samples may be transmitted to the surface unit 306 on termination, based on a data buffer stored in the memory of the apparatus 100. This stored data buffer may be a moving time window type buffer, such that upon receipt of a command to terminate data collection, the rate sensor 102 is configured to stop collecting and storing data and transmit the contents of the data buffer to the surface unit 306. Upon completion of the data transmission, the rate sensor 102 may resume collecting and storing data.

The skilled person will appreciate that the above method may allow azimuth, inclination and depth of the borehole to be determined at the point of the borehole corresponding to the location of the apparatus 100. Azimuth and inclination may be determined from the data collected by the rate sensor 102 and the accelerometer 112 respectively, while depth may be determined because the operator/driller knows the length of the first section of drill pipe 312*a*.

The azimuth determined using the data collected by the rate sensor 102, and the inclination determined using data collected by the accelerometer 112, may be used to compare the borehole being created to a proposed path. In this way, an operator of the drill rig 302 may take corrective action during the next drilling step if the azimuth (and optionally inclination) of the borehole does not correspond to the proposed path.

Once connection of the further section of drill pipe 312*b* has been completed, the motor 310 of the drilling tool 304 may once again be actuated to rotate the drill bit 308. The drill rig 302 may apply a force to the drilling tool 304 via the first and further sections of drill pipe 312*a*, 312*b*. This causes the drill bit 308 to begin drilling through the ground and advance the borehole. The drilling tool 304 may be advanced until a required depth is once again reached, see FIG. 4*d*.

One the required depth is reached, a further section of drill pipe 312*c* may be connected to the section of drill pipe 312*b*, and the same process as mentioned above in relation to the connection of the section of drill pipe 312*b* may be repeated. That is, the drill pipe extension detector 104 may detect the process associated with extension of the drill pipe, and initiate or terminate collection of data by the rate sensor 102.

As described above, in exemplary arrangements the surface unit 306 and the apparatus 100 may be in power and/or data communication. In exemplary arrangements, the apparatus 100 may be in power and/or data communication with the surface unit 306 along one or more sections of drill pipe. Specifically, the apparatus may be in power and/or data communication with the surface unit along conductor cables of the one or more sections of drill pipe. As such, loss of data communication and/or electrical power communication may occur during connection of a further section of drill pipe, when the conductor cable is severed, and the data communication and/or electrical power communication may be re-established once the further section of drill pipe is connected and the conductor cable is spliced to the conductor cable of the further section of drill pipe 312*b*.

In exemplary arrangements, the drill pipe extension detector 104 may comprise a connection detector. The connection detector may be configured to detect a change of state of a communications connection between the apparatus 100 and the surface unit 306. The communication between the apparatus 100 and the surface unit 306 may be data communication and/or electrical power communication. Electrical power communication may comprise the supply of power to the apparatus 100. The connection detector may be configured to detect the loss, reconnection or any other change of electrical power, and/or loss, reconnection or any other change of data communications connection. Initiation and/or termination of collection of data by the rate sensor may occur based on a detection of the loss/reconnection of electrical power and/or data communication.

An exemplary apparatus and method for determining azimuth when the drill pipe extension detector 104 comprises a connection detector will now be described.

In exemplary arrangements, the surface unit 306 may comprise an external power source. In such arrangements, the apparatus 100, and specifically the rate sensor 102, may receive electrical power from the external power source along the one or more sections of drill pipe.

The apparatus 100 may comprise a local power source. The local power source may comprise a battery. In exemplary arrangements, the battery may be a rechargeable battery.

In exemplary arrangements, the connection detector 104 may comprise a power source monitor and optionally a power source switch.

The power source monitor may be configured to determine the source of the electrical power being received by the apparatus 100. In exemplary arrangements, the power source monitor may be configured to determine whether power is received by the apparatus 100 from the external power source.

The power source switch may be configured to switch the supply of electrical power to the apparatus 100 from the external power source to the local power source and vice versa.

At the start of the drilling operation, for example in the position shown in FIG. 4*a*, the power source monitor determines that the apparatus 100 is receiving electrical power from the external power source. In exemplary arrangements, the apparatus 100 may receive power from the external power source and the local power source. In such arrangements, the power source monitor may be configured to determine that the apparatus 100 is receiving power from at least the external power source.

In exemplary arrangements, the power source monitor 213 may determine the source of the electrical power being received by the apparatus 100, and optionally the amount of the electrical power being received by the apparatus 100, continuously. In alternative arrangements, the power source monitor 213 may determine the source of the electrical power being received by the apparatus 100, and optionally the amount of electrical power being received by the apparatus 100 at intervals. For example, the power source monitor 213 may monitor the source of the electrical power received by the apparatus 100, and optionally the amount of electrical power received by the apparatus 100, periodically.

In exemplary arrangements, the power source monitor may determine the source of the electrical power received by the apparatus 100 based on a comparison with a threshold.

In exemplary arrangements, the threshold may comprise a voltage threshold. The skilled person will however appreciate that in alternative arrangements, alternative thresholds may be used.

The voltage threshold may be set in dependence on the voltage supplied by the external power source and/or the voltage supplied by the local power source. The external power source may supply electrical power at a first voltage and the local power source may supply electrical power at a second voltage, different to the first voltage. In exemplary arrangements, the first voltage supplied by the external power source may be greater than the second voltage supplied by the local power source. However, the skilled person will appreciate that the first voltage supplied by the external power source could be less than that supplied by the local power source.

An external voltage threshold may be used to determine that power is being received from the external power source. The external voltage threshold may comprise the voltage supplied, or capable of being supplied, by the external power source. In alternative arrangements, the external voltage threshold may comprise the combined voltage supplied by, or capable of being supplied by, the external power source and the local power source. In exemplary arrangements, the power source monitor may determine that electrical power is being supplied by the external power source if the voltage supplied to the apparatus is greater than or equal to the external voltage threshold.

In alternative arrangements, the threshold may comprise a current threshold. In such arrangements, the power source monitor may determine the source of the electrical power received by the apparatus 100 based on the electrical current received by the apparatus 100. For example, an external current threshold may be used to determine that electrical power is being received from the external power source. The external current threshold may comprise the current supplied, or capable of being supplied, by the external power source. In alternative arrangements, the external current threshold may comprise the combined current supplied by, or capable of being supplied by, the external power source and the local power source. In exemplary arrangements, the power source monitor may determine that electrical power is being supplied by the external power source if the current supplied to the apparatus is greater than or equal to the external current threshold.

As the power source monitor determines that the apparatus 100 is receiving electrical power from the external power source, the power source monitor does not activate the power source switch to switch the supply of electrical power to the apparatus 100 from the external power source to the local power source.

During extension of the drill pipe, for example by connection of the further section of drill pipe 312*b* to the first section of drill pipe 312*a*, electrical power is not received by the apparatus 100, or the drilling tool 304, from the external power source. This is because connecting the further section of drill pipe 312*b* may comprise severing the conductor cable of the first section of drill pipe 312*a*. This breaks the electrical connection between the apparatus 100 and the external power source.

The power source monitor may determine that electrical power is not being received by the apparatus 100 from the external power source. The power source monitor therefore activates the power source switch to switch the supply of electrical power to the apparatus 100 from the external power source, to the local power source. In exemplary arrangements, the power source switch may activate the local power source to supply electrical power to the apparatus 100 when the power source monitor determines that electrical power is not being received from the external power source.

In exemplary arrangements, determining that the electrical power is not being received from the external power source comprises comparing the voltage supplied to the apparatus 100 to a threshold. The threshold may be the external voltage threshold. In such arrangements, the power source monitor may determine that electrical power is not being received from the external power source if the voltage supplied to the apparatus 100 is less than the external voltage threshold. In alternative arrangements, the threshold may be the external current threshold, and the power source monitor may determine that electrical power is not being received from the external power source if the current supplied to the apparatus 100 is less than the external current threshold.

In further alternative arrangements, the threshold may be a local voltage threshold or a local current threshold. The local voltage threshold may comprise the voltage supplied, or capable of being supplied, by the local power source. In such arrangements, the power source monitor may determine that electrical power is not being received from the external power source if the voltage supplied to the apparatus 100 is substantially equal to the local voltage threshold. The local current threshold may comprise the current supplied, or capable of being supplied, by the local power source. The power source monitor may determine that electrical power is not being received from the external power source if the current supplied to the apparatus 100 is substantially equal to the local current threshold The rate sensor 102 may be configured to collect data indicative of its direction with respect to the earth's axis of rotation on receipt of electrical power from the local power source. In exemplary arrangements, the rate sensor may be configured to collect data to allow determination of an azimuth of the drilling tool 304 by gyrocompassing on receipt of electrical power from the local power source. Gyrocompassing may comprise taking measurements of the earth's rate of rotation at a plurality of orientations to allow determination of first and second earth rate vectors. The first and second earth rate vectors may then be resolved to determine the azimuth.

The skilled person will appreciate that determining the azimuth of the drilling tool 304 at a point during creation of the borehole provides an indication of the azimuth of the borehole at that point. As such, the determined azimuth may be compared against a proposed borehole path to determine whether the operator of the drill rig 302 is required to take corrective action.

In exemplary arrangements, the rate sensor 102 may be configured to repeatedly collect data at the plurality of orientations until the power source monitor determines that electrical power is once again received by the apparatus 100 from the external power source. In exemplary arrangements, the power source monitor may determine that electrical power is being supplied to the apparatus 100 by the external power source if the voltage supplied to the apparatus is equal to or above the external voltage threshold. In this way, a plurality of readings at each orientation may be collected and averaged to increase the accuracy of the gyrocompass.

The azimuth determined using the data collected by the rate sensor 102, and the inclination determined using data collected by the accelerometer 112, may be used to compare the borehole being created to the proposed path. In this way, an operator of the drill rig 302 may take corrective action during the next drilling step if the azimuth (and optionally inclination) of the borehole does not correspond to the proposed path.

Connection of the further section of drill pipe 312*b* to the first section of drill pipe 312*a*, may comprise splicing a conductor cable of the further section of drill pipe 312*b* to the conductor cable of the first section of drill pipe 312*a*. As such, on connection of the further section of drill pipe 312*b*, electrical power may once again be supplied to the drilling tool 304 and the apparatus 100 by the external power source. The electrical power may be supplied to the apparatus 100 along the first section of drill pipe 312*a* and the further section of drill pipe 312*b*.

The power source monitor may determine that electrical power is once again being received by the apparatus 100 from the external power source. In exemplary arrangements, the power source monitor may determine that electrical power received by the apparatus 100 from the external power source is above the external voltage (or external current) threshold. The power source monitor may activate the power source switch to switch the supply of electrical power to the apparatus 100 from the local power source and back to the external power source.

In exemplary arrangements, the rate sensor 102 may continue to take measurements when the apparatus 100 is connected to the external power source, but the data collected by the rate sensor 102 may not be recorded. Further, the accelerometer 112 may continue to take measurements when the apparatus 100 is connected to the external power source, but the data collected by the accelerometer 112 may not be recorded. That is, the data may not be stored in the memory 206 of the apparatus 100. In exemplary arrangements, the data collected by the rate sensor 102 and/or the accelerometer 112 when the apparatus 100 is connected to the external power source may be transmitted to surface. This data may be used to track azimuth between gyrocompass points, provide information on inclination trend or provide data that can be used for magnetometer referencing.

Once connection of the further section of drill pipe 312*b* has been completed, the motor 310 of the drilling tool 304 may once again be actuated to rotate the drill bit 308 using electrical power supplied by the external power source. The drill rig 302 may apply a force to the drilling tool 304 via the first and further sections of drill pipe 312*a*, 312*b*. This causes the drill bit 308 to begin drilling through the ground and advance the borehole. The drilling tool 304 may be advanced until a required depth is once again reached, see FIG. 4*d*.

One the required depth is reached, a further section of drill pipe 312*c* may be connected to the section of drill pipe 312*b*, and the same process as mentioned above in relation to the connection of the section of drill pipe 312*b* may be repeated. That is, the power source monitor may determine that electrical power is no longer being received from the external power source and control the power source switch to switch the supply of electrical power from the external power source to the local power source. The rate sensor 102 may then begin to collect data indicative of the earth's rate of rotation to enable determination of the azimuth by gyrocompassing. The same process may be repeated on connection of further sections of drill pipe until the drilling tool 304 reaches the exit point and the borehole has been completely created.

The methods outlined above are exemplary methods for determining when to initiate a gyrocompass based on the source of the electrical power received by the apparatus, and an exemplary method for switching the source of electrical power between the external power source and the local power source. The skilled person will however appreciate that there are alternative ways of initiating a gyrocompass.

An advantage of the above-mentioned methods is that the determination of azimuth takes place during the time that is usually taken to connect sections of drill pipe. As such, there is little to no impact on the time taken to perform the drilling operation and complete the creation of the borehole. Operational efficiency is therefore not impacted.

Further, since the azimuth is determined using rate sensors, such as gyro sensors, the data collected is not subject to local magnetic interference like in magnetic guidance systems. Therefore, these methods do not require reference guidance techniques on the surface (such as the grids of cable described above), and as such, there are no periods of "blind" drilling when it is not possible to use the surface over a portion of the borehole. Further, since the gyrocompass measurements are independent of each other, the risk of systematic errors is reduced.

As mentioned above, in exemplary arrangements the local power source may comprise a rechargeable battery. The rechargeable battery may be configured to recharge using electrical power received from the external power source. In exemplary arrangements, the rechargeable battery may be configured to recharge using electrical power received from the external power source when the power source monitor determines that the electrical power is being received by the apparatus 100 from the external power source. In exemplary arrangements, the rechargeable battery may be configured to recharge using electrical power received from the external power source, if the electrical power received is above a charging threshold. Advantageously, this allows a low capacity battery to be used, since the battery may be regularly recharged. As such, the battery may be smaller (and therefore the apparatus size may be reduced) when compared to higher capacity batteries. Additionally, the apparatus may be suitable for use in extended boreholes since battery capacity is not an issue.

In further exemplary arrangements, the rechargeable battery may be configured to recharge using electrical power received from alternative sources. For example, an alternative power source located in the borehole, such as a downhole generator. In exemplary arrangements, the downhole generator may be located on one of the apparatus 100 or the drilling tool 304.

In exemplary arrangements, the local power source may be configured to enter a low power mode or a sleep mode if electrical power is not received from the external power source for a threshold time period. In the sleep mode, the local power source may be configured not to provide electrical power to one or more components of the apparatus 100, for example the rate sensor 102. In this way, battery power may be conserved when the apparatus 100 is inactive for long periods of time. This may be, for example, due to drilling problems, rig failures or operating restrictions. In exemplary apparatus, the local power source may be configured to exit the sleep mode and resume operation when electrical power is once again received from the external power source. In exemplary arrangements, the local power source may be configured to exit the sleep mode and resume operation when the power source monitor determines that the electrical power is being received from the external power source.

The exemplary apparatus 100 may further comprise a battery charge indicator. The battery charge indicator may be configured to determine and provide battery status data. For example, the battery charge indicator may be configured to determine a power level or percentage charge level of the rechargeable battery.

The transmitter 202 may transmit the battery status data to surface. The battery status data may enable an operator of the drill rig 302 to determine an amount of electrical power required by the apparatus 100 from the external power source. For example, it may be necessary for the external power source to provide the apparatus 100 with more power for recharging of the local power source if the drilling rate is relatively fast. This is because the external power source will be supplying electrical power to the apparatus 100 for shorter periods of time between drill pipe connections, when compared slower drilling rates, in which the apparatus 100 will be connected to the external power source for longer periods of time between drill pipe connections.

In alternative arrangements, the apparatus 100 may alternatively, or additionally, be in data communication with the surface unit. Data communication may comprise one or more of: electrical signalling, RF communication, acoustic communication, optical communication and/or mud pulse communication. In such arrangements, the apparatus 100 may not be in electrical power communication with the surface unit, although the skilled person will appreciate that in alternative arrangements, the apparatus may be in both electrical power communication and data communication with the surface unit.

The connection detector may be configured to detect loss of data communication between the rate sensor and the surface unit. The rate sensor 102 may be configured to collect data when the connection detector detects loss of data communication between the rate sensor and the surface unit. This process may be similar to the process described above in respect of loss of electrical power.

The skilled person will appreciate that one or more of the operations described above and performed by the apparatus 100, as a result of loss and/or reestablishment of electrical power communication between the apparatus 100 and the external power source may equally be performed as a result of loss and/or re-establishment of data communication between the apparatus 100 and the surface unit. For example, the transmitter of the apparatus may be configured to transmit data collected by the rate sensor to the surface unit when the apparatus is again in data communication with the surface unit. Further, the accelerometer may be configured to collect data as described above when loss of data communication is detected between the apparatus and the surface unit.

Loss of data communication may be used to activate the rate sensor in arrangements in which electrical power does not need to be supplied to the apparatus by the external power source. For example, the apparatus 100 may comprise a local power source of sufficient capacity to power the apparatus 100 throughout the complete drilling operation, or alternatively a downhole power source of sufficient capacity may power the apparatus 100 throughout the complete drilling operation. In such arrangements, connection of the drill pipe section may not sever the power supply to the apparatus from an external power source, but may sever the data connection between the apparatus and the surface unit.

The methods described above each refer to collection of data by the rate sensor. Collection of data by the rate sensor 102 may comprise rotating the rate sensor 102 about an axis of the apparatus 100 and recording the output of the rate sensor 102 at multiple angular orientations. This technique may be referred to as gyrocompassing or northseeking. The skilled person will be familiar with such techniques, however an exemplary method is explained below.

In exemplary methods, the rate sensor 102 may be rotated about an axis, such as the longitudinal axis 106 at a plurality of angular orientations, for example, at 90 degrees, 180 degree, 270 degrees and 360 degrees. The output of the rate sensor 102 at each of these orientations may be recorded. The skilled person will appreciate that data may be collected by the rate sensor 102 at any number of orientations as the rate sensor 102 is rotated about the longitudinal axis 106.

In exemplary methods data is collected by the rate sensor 102 at at least one pair of orientations separated by 180 degrees. The skilled person will appreciate that data collected by the rate sensor need not be separated by 180 degrees to enable azimuth to be determined by gyrocompassing, and in exemplary methods alternative angular separations may be used. The below method describing a gyrocompass using measurements separate by 180 degrees is given as a non-limiting example. The data collected by the rate sensor 102 comprises a bias (or error) term and a component of the earth's horizontal rate of rotation. Measurements that are separated by 180 degrees have equal but opposite values, and as such may be subtracted to eliminate the bias term to allow the earth's horizontal rate of rotation component to be determined. Similarly, measurements that are separated by 180 degrees may be added together to eliminate the earth's horizontal rate of rotation term and allow the bias term to be determined.

In exemplary methods, the rate sensor 102 may collect data at two or more pairs of orientations separated by 180 degrees. For example, the rate sensor 102 may collect data at first and second orientations, angularly separated by 180 degrees (a first pair of orientations). The rate sensor 102 may further collect data at third and fourth orientations, angularly separated by 180 degrees (a second pair of orientations). This allows first and second horizontal earth rate components to be determined, which may be resolved to determine the azimuth.

The skilled person will further appreciate that the rate sensor 102 may additionally or alternatively be rotated about further axes, for example an axis perpendicular to the longitudinal axis 106, and collect data at one or more discrete angular orientations. For example, the rate sensor 102 may additionally or alternatively be rotated about an axis perpendicular to the longitudinal axis 106 to collect data when the apparatus is substantially horizontal (for example, when the borehole approached horizontal inclinations).

In exemplary arrangements, the rate sensor 102 may be configured to repeatedly collect data at the plurality of orientations. In this way, a plurality of readings at each orientation may be collected and averaged to increase the accuracy of the gyrocompass.

A similar process may be undertaken by the accelerometer 112. That is, the accelerometer 112 may be rotated about an axis of the apparatus 100 and the output of the accelerometer may be recorded at multiple angular orientations. The data collected by the accelerometer 112 may be used to determine an inclination. The skilled person will be familiar with methods used to determine the inclination using data collected by the accelerometer 112.

The data collected by the rate sensor 102, and the accelerometer 112, may be transmitted to surface by the transmitter 202. In alternative arrangements, the data collected by the rate sensor 102 may be stored in the memory 206 of the apparatus and transmitted to surface on detection of a process associated with extension of the drill pipe, as described above.

The skilled person will appreciate that the above method may allow azimuth, inclination and depth of the borehole to be determined at the point of the borehole corresponding to the location of the apparatus 100. Azimuth and inclination may be determined from the data collected by the rate sensor 102 and the accelerometer 112 respectively, while depth may be determined because the operator/driller knows the length of the drill pipe.

In exemplary arrangements, the apparatus may change a measurement mode on detection of the process associated with extension of the drill pipe. For example, in a first measurement mode, the apparatus may be configured to collect the data indicative of the rate of rotation of the earth for determining the azimuth by gyrocompassing and store the data in the memory 206 of the apparatus. In a second measurement mode, the transmitter 202 of the apparatus 100 may be configured to transmit the data to surface, for example to the surface unit. The apparatus 100 may switch between the first measurement mode and the second measurement mode on detection of the process associated with extension of the dill pipe. In alternative arrangements, a motion sensor may be used to detect motion of the apparatus 100. The apparatus 100 may switch between the first measurement mode and the second measurement mode based on detection of motion. For example, the apparatus may be configured to enter the first measurement mode if the motion sensor detects that the apparatus is substantially stationary, and enter the second measurement mode if the motion sensor detects movement of the apparatus.

In exemplary methods described above, the apparatus is configured to initiate (e.g. commence, start of change a sequence of measurements, or change a measurement mode) collection of data in respect to detection of a process associated with extension of the drill pipe. As described however, the apparatus may additionally or alternatively terminate (e.g. conclude, stop or change a sequence measurements or change a measurement move) in response to detection of the process associated with extension of the drill pipe. For example, in exemplary arrangements, the apparatus 100 may be configured to continuously collect data as it travels through the borehole during a drilling operation. The data collected may be stored in the memory 206 of the apparatus 100. In such arrangements, the apparatus 100 may be commanded to terminate the continuous measurement, as opposed to initiating measurement (since the apparatus is already measuring) to allow data to be transmitted to surface for determination of azimuth by gyrocompassing. For example, in response to detection of the process associated with extension of the drill pipe, the apparatus 100 may terminate the continuous measurement and control the transmitter 202 to transmit the data stored in the memory 206 to surface. For example, the apparatus may control the transmitter 202 to transmit the data stored in the memory 206, as described above, on reconnection of the apparatus to the external power supply, or once data communication between the apparatus 100 and the surface unit 306 is restored.

In horizontal directional drilling, the borehole that is created, for example as described above, may be referred to as a pilot hole. On completion of the pilot hole, a hole opener assembly may be coupled to the first section of drill pipe on surface, at the exit point. The drilling tool 304 and the hole opener assembly may then be pulled back through the pilot hole, and through the sections of drill pipe 312, towards the entry point (i.e. the point at which drilling began). Pulling the hole opener assembly through the pilot hole increases the diameter of the pilot hole to allow insertion of the utility, for example a conduit.

In exemplary methods, the apparatus 100 may be detached from the drilling tool 304 and pulled back through the pilot hole (or borehole) to measure azimuth and/or inclination of the pilot hole. For example, the apparatus 100 may be pulled back through the pilot hole using a wire. In this way, a survey of the pilot borehole path may be conducted, and the profile of the pilot borehole path may be confirmed. In exemplary methods, the apparatus 100 may be pulled back through the pilot hole before the hole opener assembly is pulled through the pilot borehole to increase the diameter of the borehole.

The apparatus 100 may collect data relating to azimuth and/or inclination by gyrocompassing, as described above, and/or continuous measurement methods which will be familiar to the skilled person.

A computer program may be configured to provide any of the above described methods. The computer program may be provided on a computer readable medium. The computer program may be a computer program product. The product may comprise a non-transitory computer usable storage medium. The computer program product may have computer-readable program code embodied in the medium configured to perform the method. The computer program product may be configured to cause at least one processor to perform some or all of the method.

Computer program instructions may also be stored in a computer-readable medium that can direct a computer or other programmable data processing apparatus to function in a particular manner, such that the instructions stored in the computer-readable medium produce an article of manufacture including instructions which implement the functions/acts specified in the block diagrams and/or flowchart block or blocks.

A tangible, non-transitory computer-readable medium may include an electronic, magnetic, optical, electromagnetic, or semiconductor data storage system, apparatus, or device. More specific examples of the computer-readable medium would include the following: a portable computer diskette, a random access memory (RAM) circuit, a read-only memory (ROM) circuit, an erasable programmable read-only memory (EPROM or Flash memory) circuit, a portable compact disc read-only memory (CD-ROM), and a portable digital video disc read-only memory (DVD/Blu-ray).

The computer program instructions may also be loaded onto a computer and/or other programmable data processing apparatus to cause a series of operational steps to be performed on the computer and/or other programmable apparatus to produce a computer-implemented process such that the instructions which execute on the computer or other programmable apparatus provide steps for implementing the functions/acts specified in the block diagrams and/or flowchart block or blocks.

Accordingly, the invention may be embodied in hardware and/or in software (including firmware, resident software, micro-code, etc.) that runs on a processor, which may collectively be referred to as "circuitry," "a module" or variants thereof.

The skilled person will be able to envisage other embodiments without departing from the scope of the appended claims.

The invention claimed is:

1. An apparatus for determining an azimuth of a drilling tool during drilling of a borehole, and comprising:

a rate sensor configured to collect rate sensor data indicative of a component of a rate of rotation of the earth for determining the azimuth by gyrocompassing, and further configured for communication with a surface unit;

a drill pipe extension detector configured to detect a process associated with extension of a drill pipe connecting the drilling tool to the surface unit, wherein the extension of the drill pipe comprises new sections of drill pipe being connected to one or more sections of drill pipe at surface as the borehole advances during drilling;

a transmitter configured to transmit rate sensor data collected during the extension of the drill pipe to the surface unit, for determination of the azimuth, based on the detection of the process associated with extension of the drill pipe; and wherein the process associated with the extension of the drill pipe comprises a loss of communication between the rate sensor and the surface unit.

2. An apparatus according to claim 1, wherein the drill pipe extension detector is configured to detect completion of the process associated with extension of the drill pipe and control the rate sensor to terminate collection of the rate sensor data and the transmitter to transmit previously collected rate sensor data to the surface unit.

3. An apparatus according to claim 1, wherein the drill pipe extension detector is configured to detect initiation of the process associated with extension of the drill pipe and control the rate sensor to commence collection of the rate sensor data.

4. An apparatus according to any claim 1, wherein the drill pipe extension detector is configured to determine that the apparatus is stationary during the process associated with the extension of the drill pipe.

5. An apparatus according to claim 1, wherein the process associated with extension of the drill pipe further comprises one or more of: a sequence of movements of the drill pipe; a change in detected pressure in the borehole; a detected shock experienced by the apparatus; and a change in detected vibration and/or acceleration of the apparatus.

6. An apparatus according to claim 1, wherein the communication between the rate sensor and the surface unit is electrical power communication and/or data communication.

7. An apparatus according to claim 6, wherein the drill pipe extension detector comprises a connection detector, and wherein the communication is electrical power communication, wherein the surface unit comprises an external power source in electrical power communication with the rate sensor such that the rate sensor receives electrical power from the external power source, and wherein the apparatus further comprises a local power source configured to provide electrical power to the rate sensor when the connection detector detects loss of electrical power communication between the rate sensor and the external power source.

8. An apparatus according to claim 7, wherein the rate sensor and/or the local power source is located on the drilling tool, and/or wherein the external power source is located at surface.

9. An apparatus according to claim 7, wherein the local power source is configured not to provide electrical power to the rate sensor when electrical power is received from the external power source.

10. An apparatus according to claim 7, wherein the rate sensor is configured to receive electrical power from the external power source along the drill pipe connecting the drilling tool to the surface unit, and wherein electrical power is not received from the external power source during the process associated with extension of the drill pipe.

11. An apparatus according to claim 10, further comprising the external power source and/or the drill pipe.

12. An apparatus according to claim 7, wherein the local power source comprises a rechargeable battery.

13. An apparatus according to claim 12, wherein the rechargeable battery is configured to recharge using electrical power received from the external power source.

14. An apparatus according to claim 12, further comprising a battery charge indicator configured to determine a power level of the rechargeable battery and control the transmitter to transmit battery status information when electrical power is received from the external power source.

15. An apparatus according to claim 1, wherein the rate sensor is configured to collect the data indicative of the rate of rotation of the earth by taking measurements at a plurality of angular orientations.

16. An apparatus according to claim 1, wherein the drill pipe extension detector is configured to detect initiation of the process associated with extension of the drill pipe and control the rate sensor to commence collection of the rate sensor data, and wherein the transmitter is configured to transmit the data indicative of a rate of rotation of the earth on completion of the process associated with extension of the drill pipe.

17. A horizontal directional drilling tool for creating a borehole and comprising:

an apparatus for determining an azimuth of the drilling tool during drilling of the borehole, the apparatus comprising:

a rate sensor configured to collect rate sensor data indicative of a component of a rate of rotation of the earth for determining the azimuth by gyrocompassing, and further configured for communication with a surface unit;

a drill pipe extension detector configured to detect a process associated with extension of a drill pipe connecting the drilling tool to the surface unit, wherein the extension of the drill pipe comprises new sections of drill pipe being connected to one or more sections of drill pipe at surface as the borehole advances during drilling;

a transmitter configured to transmit rate sensor data collected during the extension of the drill pipe to the surface unit, for determination of the azimuth, based on the detection of the process associated with extension of the drill pipe; and wherein the process associated with the extension of the drill pipe comprises a loss of communication between the rate sensor and the surface unit.

18. A method for determining an azimuth of a drilling tool, the method comprising:

communicating, by a rate sensor, with a surface unit;

detecting, by a drill pipe extension detector, a process associated with extension of a drill pipe connecting the drilling tool to the surface unit, wherein the extension of the drill pipe comprises new sections of drill pipe being connected to one or more sections of drill pipe at surface as the borehole advances during drilling; and transmitting, by a transmitter, rate sensor data collected during the extension of the drill pipe and indicative of a component of a rate of rotation of the earth, for determining the azimuth by gyrocompassing, to the surface unit, based on the detection of the process associated with extension of the drill pipe; and wherein the process associated with the extension of the drill pipe comprises a loss of communication between the rate sensor and the surface unit.

* * * * *